US008715005B2

(12) United States Patent
Pan

(10) Patent No.: US 8,715,005 B2
(45) Date of Patent: May 6, 2014

(54) HIGH SPEED HIGH DENSITY CONNECTOR ASSEMBLY

(75) Inventor: Feng Pan, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 64 days.

(21) Appl. No.: 13/437,886

(22) Filed: Apr. 2, 2012

(65) Prior Publication Data

US 2012/0252271 A1 Oct. 4, 2012

(30) Foreign Application Priority Data

Mar. 31, 2011 (CN) ..... 2011 1 0080651

(51) Int. Cl.
*H01R 13/648* (2006.01)

(52) U.S. Cl.
USPC ..... 439/607.1; 439/660

(58) Field of Classification Search
USPC ..... 439/79, 108, 607.05–607.07, 439/607.11–607.13, 607.17, 607.18, 701, 439/607.1, 660
See application file for complete search history.

(56) References Cited

U.S. PATENT DOCUMENTS

| | | | | |
|---|---|---|---|---|
| 5,167,528 | A | 12/1992 | Nishiyama | |
| 6,780,059 | B1 | 8/2004 | Payne | |
| 6,814,619 | B1 | 11/2004 | Stokoe | |
| 6,899,566 | B2 * | 5/2005 | Kline et al. | 439/607.56 |
| 6,913,490 | B2 * | 7/2005 | Whiteman et al. | 439/607.05 |
| 7,163,421 | B1 | 1/2007 | Cohen | |
| 7,604,502 | B2 * | 10/2009 | Pan | 439/607.08 |
| 7,811,128 | B2 * | 10/2010 | Pan | 439/607.05 |
| 7,976,340 | B1 * | 7/2011 | Saraswat et al. | 439/607.07 |
| 8,398,431 | B1 * | 3/2013 | Whiteman et al. | 439/607.06 |
| 8,398,432 | B1 * | 3/2013 | McClellan et al. | 439/607.07 |
| 8,398,434 | B2 * | 3/2013 | Davis et al. | 439/607.34 |
| 8,430,691 | B2 * | 4/2013 | Davis | 439/607.09 |
| 8,444,434 | B2 * | 5/2013 | Davis et al. | 439/607.07 |

FOREIGN PATENT DOCUMENTS

| | | |
|---|---|---|
| EP | 1166396 | 3/2008 |

* cited by examiner

*Primary Examiner* — Thanh Tam Le

(74) *Attorney, Agent, or Firm* — Ming Chieh Chang; Wei Te Chung

(57) ABSTRACT

A high speed connector assembly includes a header and a receptacle. The header includes an array of first contacts arranged in lines and columns, each line of first contacts being grouped in pairs, each of the first contacts having a contacting portion and a number of first shields arranged besides corresponding lines of the first contacts, each of the first shields having a contacting portion. The receptacle has a main body. The main body defines a front face and a number of receiving holes in the front face. The contact portions of each pair of the first contacts and corresponding first shield are received in the same one of the receiving holes when the header and the receptacle are mated.

20 Claims, 9 Drawing Sheets

HIGH SPEED HIGH DENSITY CONNECTOR ASSEMBLY

BACKGROUND OF THE INVENTION

1. Field of the Invention

The present invention relates to a high speed high density connector assembly and particularly to a high speed high density connector assembly with improved manufacturability and anti-EMI performance.

2. Description of Related Art

U.S. Pat. No. 6,899,566, issued to Kline et al. on May 31, 2005, discloses a high speed connector assembly including a header and a receptacle. The header has an array of signal pins and shield plates and the receptacle has an array of holes respectively receiving the signal pins and the shield plates. This much increases the complexity of the receptacle and insertion force when the header and the receptacle are mated. Furthermore, the shield plate is L-shaped and could not shielding the signal pins in all perimeter.

Europe Patent issued No. 1166396B1, on Mar. 19, 2008, discloses a high speed backplane connector assembly further disclosing an array of U-shaped shield plates. However, contacts of receptacle has tuning-fork-shaped contacting portion for clipping pins of the header which increases the profile of the connector and decreases the density of the connector.

Additionally, the contacts disclosed in latter two prior art references are prone to damage since the contacts are exposed to outside during most of the manufacturing processes of the connector.

SUMMARY OF THE INVENTION

An object of the present invention is to provide a high speed connector assembly comprising a first connector and a mating second connector. The first connector comprises an array of first contacts arranged in lines and columns, a plurality of first insulators and a plurality of first shields arranged in lines alternating with corresponding lines of the first contacts. Each line of first contacts are grouped in pairs adapted for transferring signal differential pairs. Each of the first contacts has a contacting portion and fastened in the first insulator. Each of the first shields has a contacting portion. The second connector has a main body, the main body defining a front face and a plurality of receiving holes in the front face. The second connector comprises an array of second contacts arranged in lines and columns, a plurality of second insulator fastening the second contacts and a plurality of second shields arranged in lines alternating with the lines of the second contacts. Each line of second contacts are grouped in pairs adapted for transferring signal differential pairs. Each of the second contacts has a contacting portion to mate with the contacting portion of corresponding first contact. Each of the second shields has a contacting portion to mate with the contacting portion of corresponding first shield. The contact portions of each pair of the first contacts and corresponding first shield are received in the same one of the receiving holes when the first connector and the second connector are mated.

Another object of the present invention is to provide a high speed connector assembly comprises a first connector and a mating second connector. The first connector comprises a pair of first contacts for transferring a signal differential pair, a first insulator fastening the pair of first contacts and a first shield having a contacting portion besides the contacting portions of the first contact pair. Each of the first contacts has a contacting portion. The second connector comprises a pair of second contacts for transferring a signal differential pair, a second insulator fastening the pair of first contacts and a second shield having a contacting portion half surrounding the contacting portions of the second contact pair with an open left. Each of the second contacts has a contacting portion to mate with the contacting portion of the first contacts respectively. The contacting portion of the first shield seals the open of the contacting portion of the second shield and forms a sealed circumference around the contacting portions of the first and the second contact pairs when the two connector are mated. The contacting portions of the second contact pair are flexible to sway towards the contacting portion of the first shield when mated with the contacting portion of corresponding first contact. The second insulator has a first portion isolating the contacting portions of the second contact pair from the contacting portion of the second shield and sheltering front ends of the second contact pair with only one side of the contacting portions of the second contact pair left reachable for the first contact pair.

Other objects, advantages and novel features of the invention will become more apparent from the following detailed description of a preferred embodiment when taken in conjunction with the accompanying drawings.

DETAILED DESCRIPTION OF THE INVENTION

Figure 1:
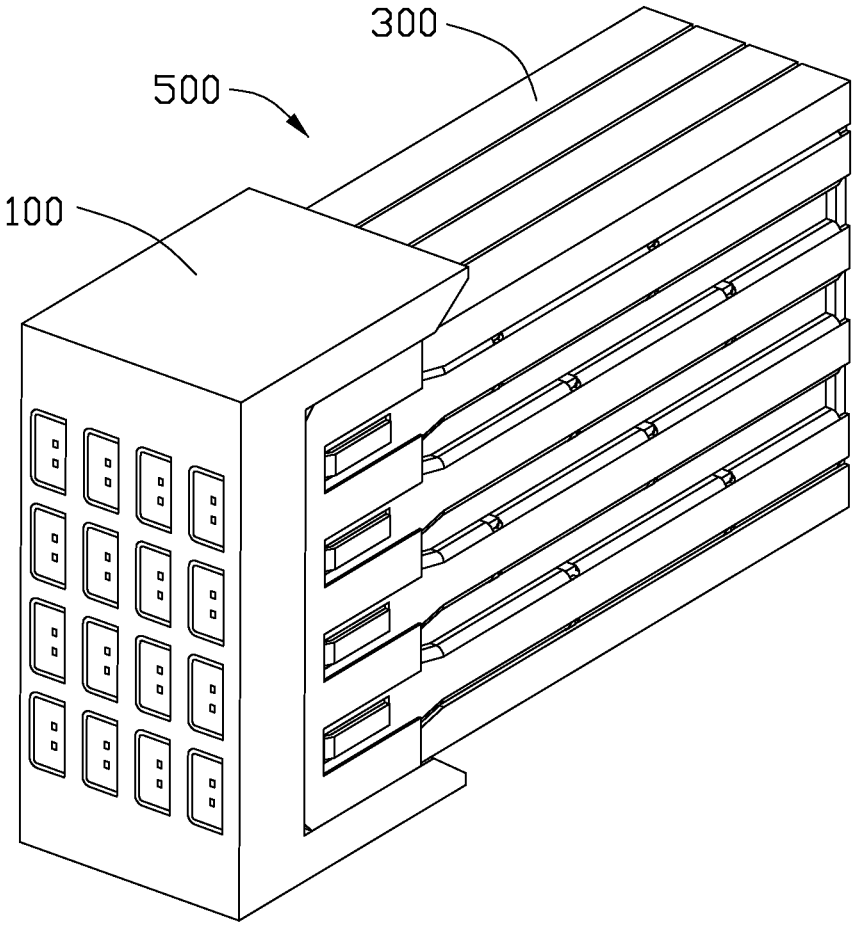
FIG. 1 is a perspective view of a high speed connector assembly in mated position according to an embodiment of the present invention.

Reference will now be made to the drawing figures to describe the present invention in detail.

Figure 2:
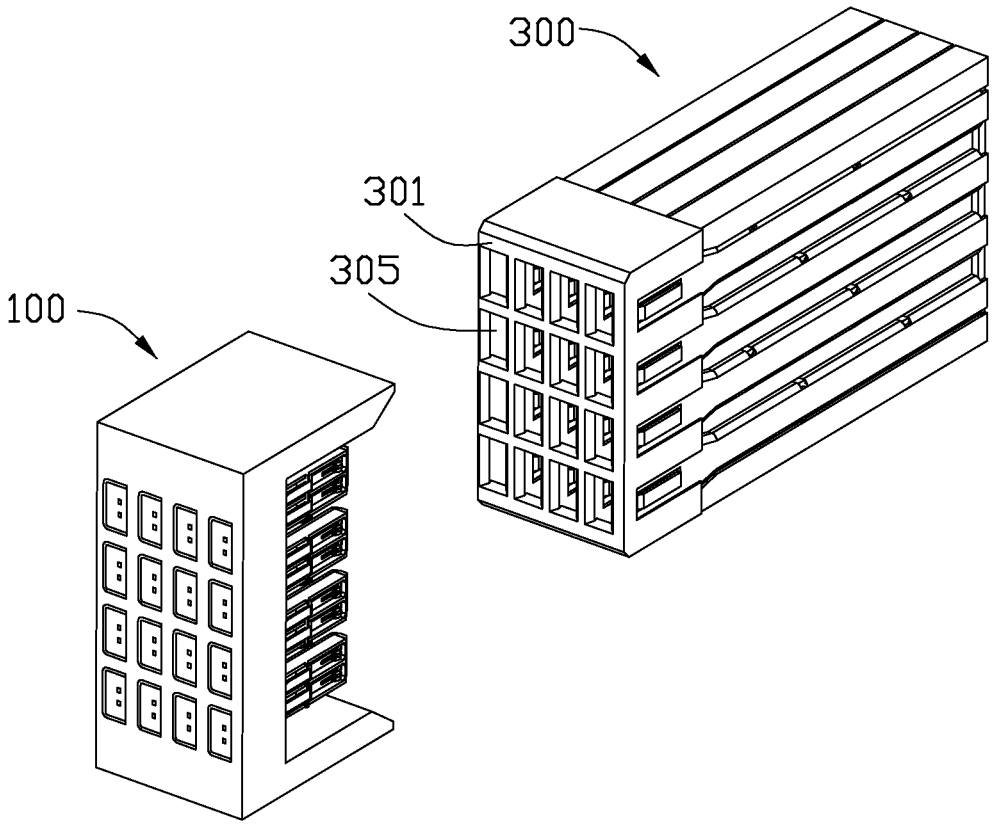
FIG. 2 is a perspective view of the high speed connector assembly shown in FIG. 1 except in unmated position.

Referring to FIGS. 1 and 2, a high speed connector assembly 500 in mated position is shown. The high speed connector assembly 500 includes a first connector 100 and a second connector 300. The second connector 300 has a main body defining a front mating face 301 and a plurality of receiving holes 305 arranged in an array.

Figure 3:
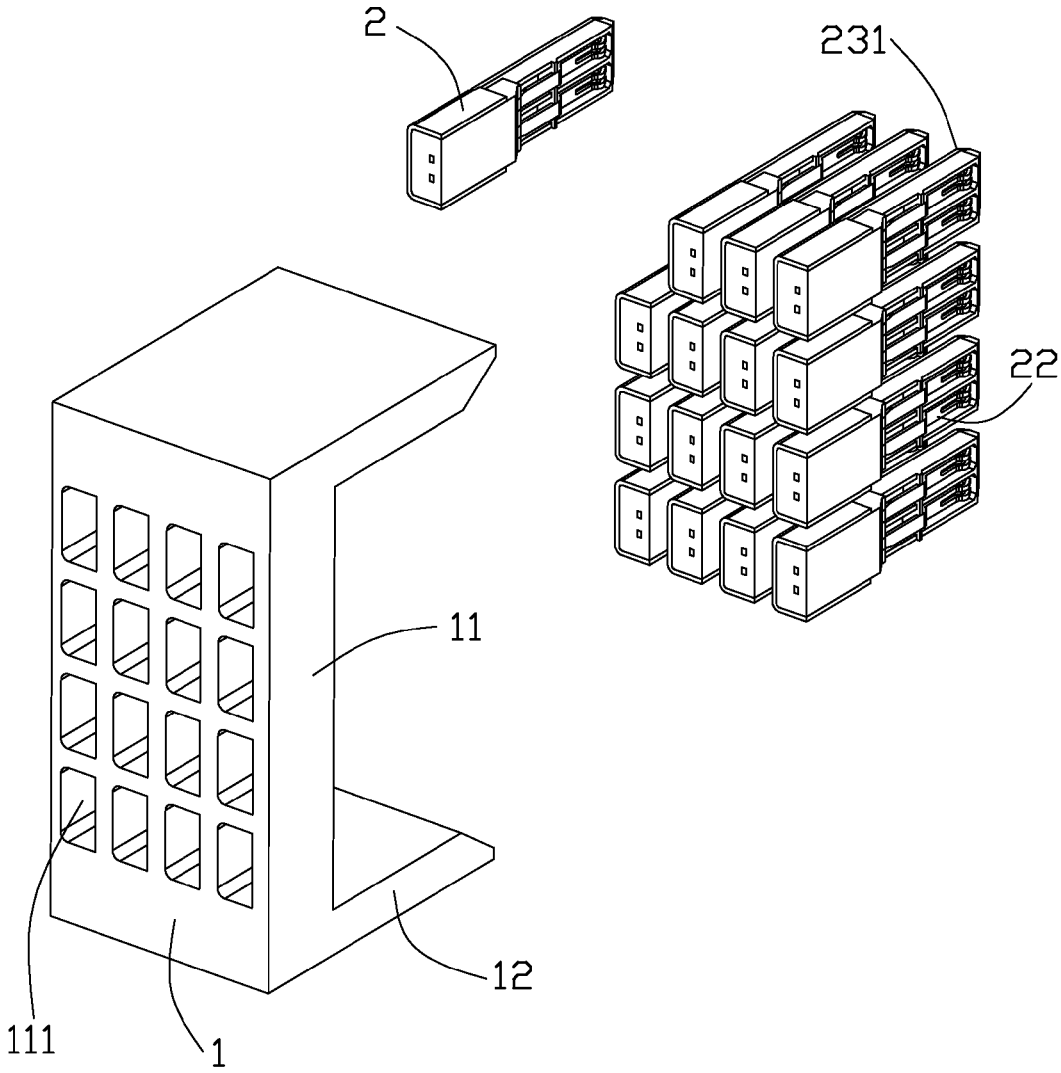
FIG. 3 is a partially exploded view of a first connector of the high speed connector assembly in FIG. 2.
Figure 4:
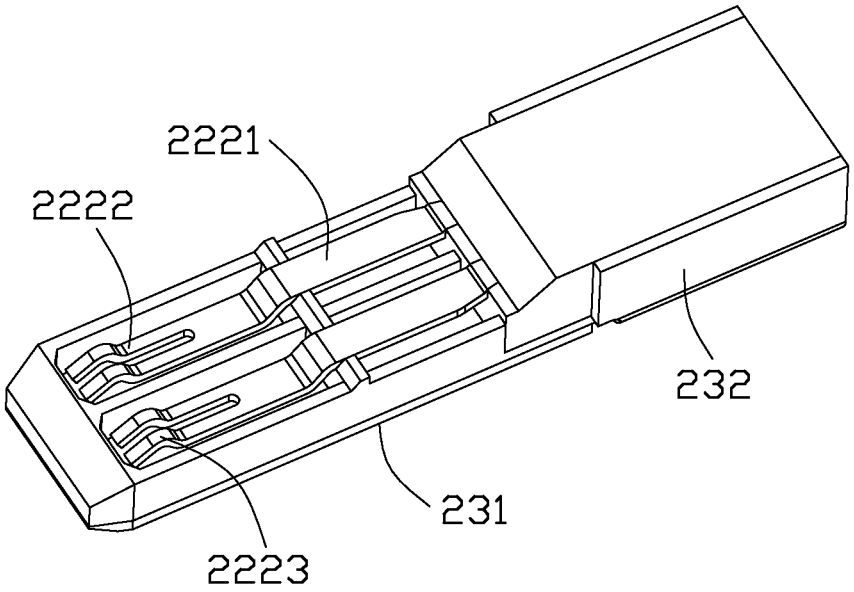
FIG. 4 is a perspective view of a connect module having a first contact pair, a first insulator and a first shield of the first connector shown in FIG. 3.
Figure 5:
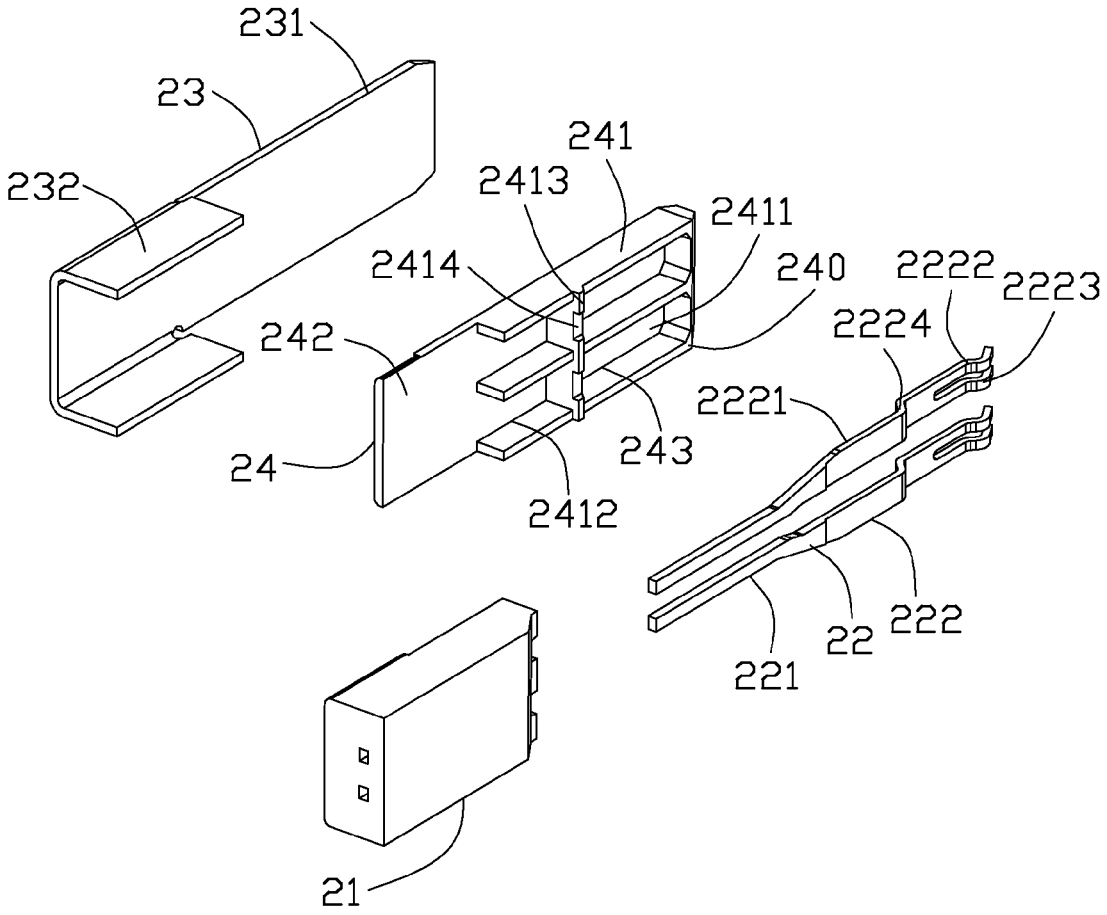
FIG. 5 is an exploded view of the contact module shown in FIG. 4.

Referring to FIGS. 3-5, the first connector 100 includes insulating housing 1 and a plurality of contact module 2. The insulating housing 1 forms a bottom wall 11 and two upstanding side walls 12 defining a receiving space to receive the second connector 300. The bottom wall 11 defines an array of through holes 111 fastening the contact modules 2. Each contact module 2 includes a first insulator 21, 24, a pair of first contacts 22 for transferring a signal differential pair and a first shield 23.

Each of the first contacts 22 has a fastening portion 221 held by the first insulator, a contacting portion 222 extending forwardly from a front end of the fastening portion 221, and a terminal portion extending backwardly from an opposite rear end of the fastening portion 221 adapted to be mounted onto a printed circuit board (not shown). The contacting portion 222 further includes a first contacting portion 2221 forwardly extending from the fastening portion 221, and a second contacting portion 2222, 2223 continuously and forwardly extending from the first contacting portion 2221 with a transverse offset 2224 comparing the first contacting portion 2221. The first contacting portion 2221 is shaped like a planar board and the second contacting portion is shaped like a tuning fork 2222, 2223. The contacting portions 222 of each first contact pair 22 and corresponding contacting portion of the first shield 23 has mating faces facing away from each other.

The first insulator comprises a first portion 24 and a second portion 21 separately molded and assembled together. The first portion 24 is disposed between a contacting portion 231 of the first shield 23 and the contacting portions 222 of corresponding first contacts pair 22. The first portion 24 isolates the contacting portions 222 of the first contact pair 22 from the contacting portion 231 of the first shield 23 and shelters front ends of the first contact pair 22 with only one side of the contacting portions 222 of the first contact pair 22 left reachable for the second connector 300. The contacting portions 222 of the first contact pair 22 are flexible to sway towards the contacting portion 231 of the first shield 23. The first portion 24 having a front section 241 and a rear section 242. The front section 241 defines two cavities 243 respectively receiving main portions of the contacting portions 222 of the second contact pair 22. Each of the cavities 243 forms a protrusion 2413 dividing the cavity 243 into a first portion 2411 and a second portion 2412. The protrusion 2413 defines a slot 2414 to position the contacting portion 222 of the first contact 22.

Figure 6:
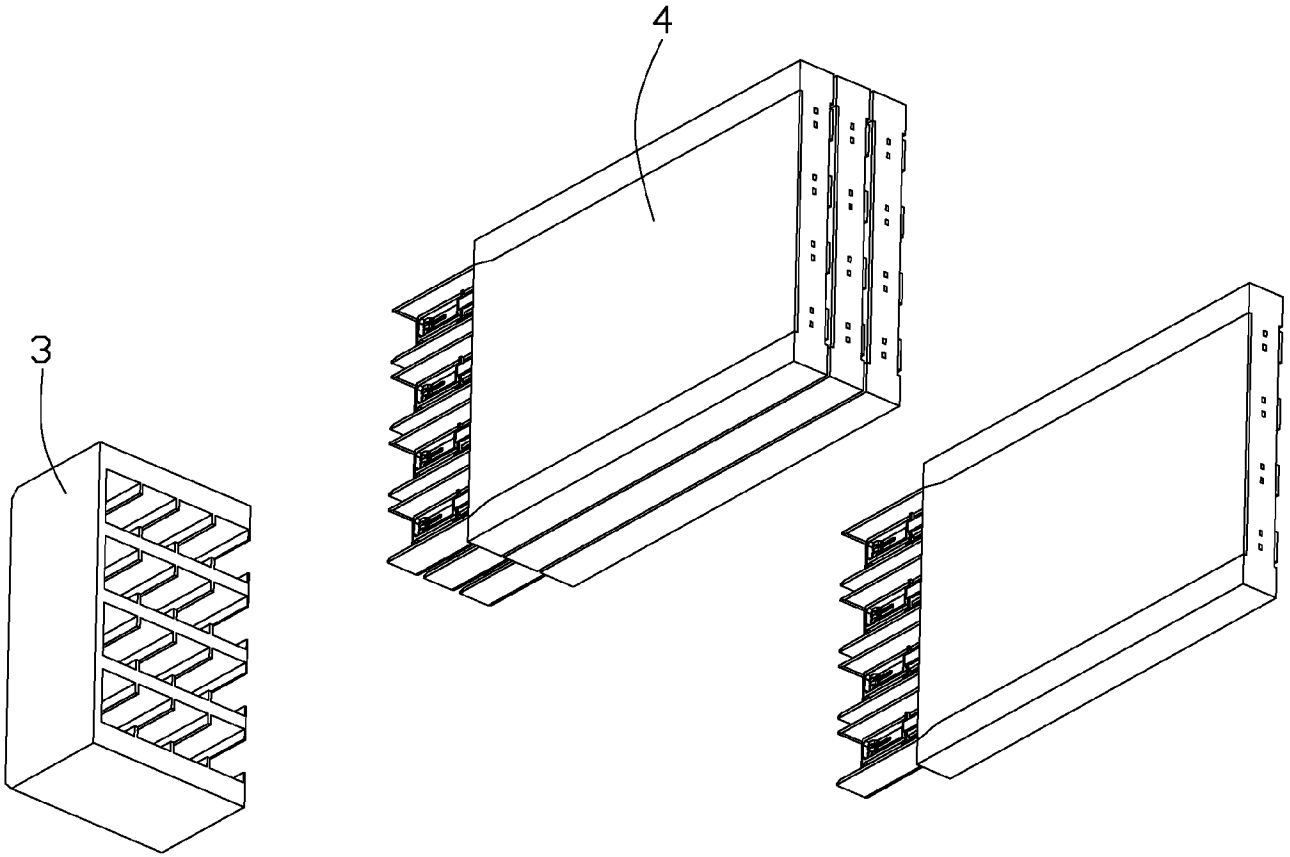
FIG. 6 is a partially exploded view of a second connector of the connector assembly shown in FIG. 2.
Figure 7:
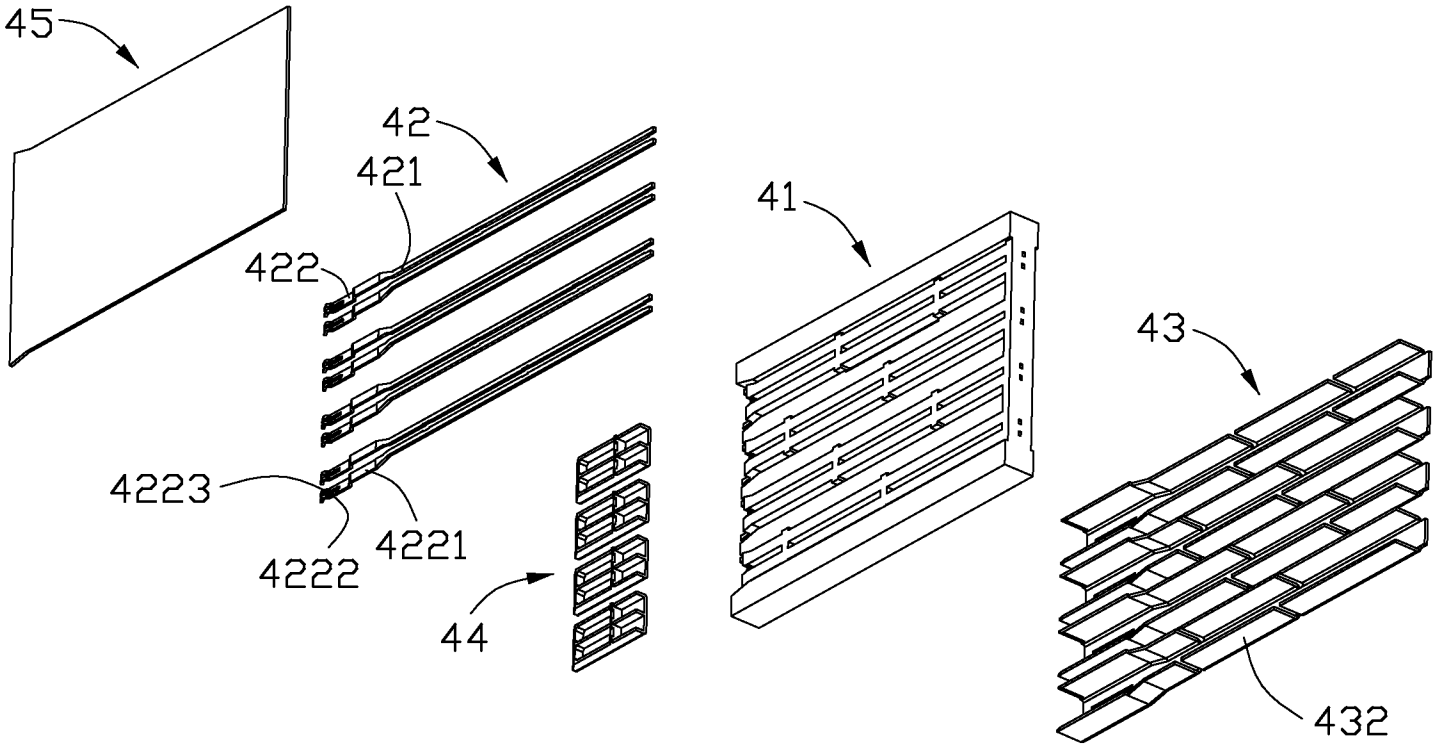
FIG. 7 is an exploded view of a contact module of the second connector shown in FIG. 6.

Referring to FIGS. 6 and 7, the second connector 300 comprises an array of second contacts 42 arranged in lines, a plurality of second insulator 41, 44 fastening pairs of the second contacts 42 and a plurality of second shields 43 arranged in lines alternating with the lines of the second contacts 42.

Figure 8:
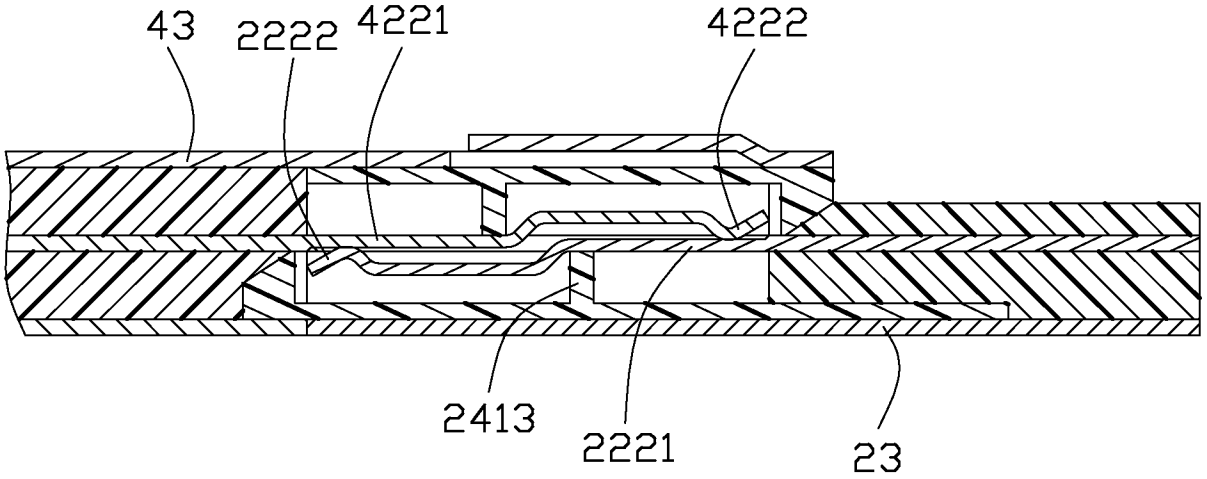
FIG. 8 is a diagram showing the engagement of the contact modules of the first connector and the second connector.
Figure 9:
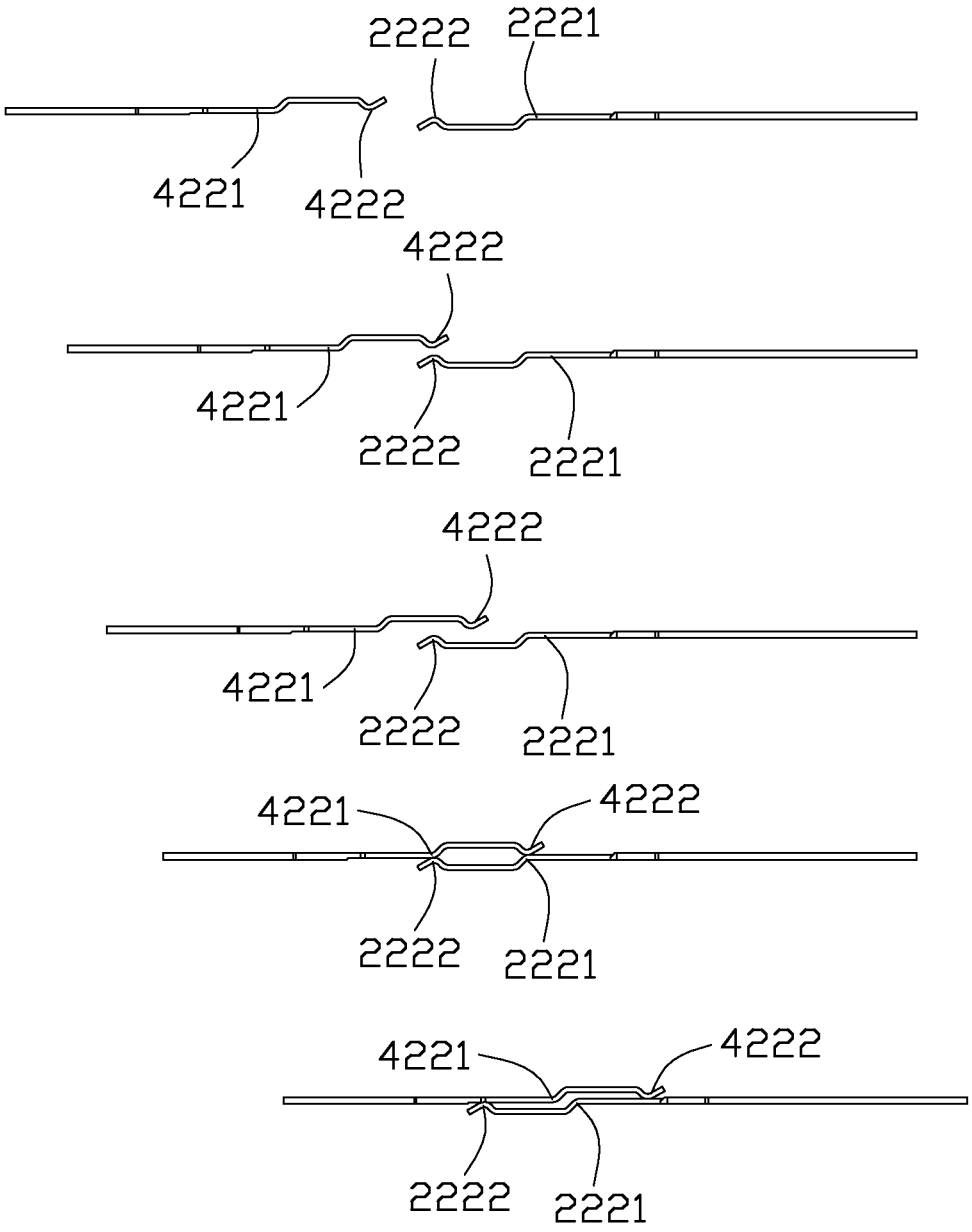
FIG. 9 is a diagram showing the engagement of the contacts of the first connector and the second connector at different time during the mating operation.

Each line of second contacts 42 being grouped in pairs adapted for transferring signal differential pairs. Each of the second contacts 42 has a fastening portion 421 and a contacting portion 422 to mate with the contacting portion of corresponding first contact 22. The contacting portion 422 has first contacting portion 4221 and second contacting portion 4222, 4223 (similar to the contacting portion 222 of the first contact 22). Each of the second shields 43 has a U-shaped contacting portion 433 to mate with the contacting portion 231 of corresponding first shield 23. During insertion of the second connector 300 into the first connector 100, the second contacting portion 2222, 2223 of the first contact 22 does not scratch the second contacting portion 4222, 4223 of the second contact 42. When the two connectors are mated, the contact portions 222, 231 of each pair of the first contacts 22 and corresponding first shield 23 are received in the same one of the receiving holes 305 (shown in FIGS. 8 and 9). This design will much decrease complexity of the second connector 300 and decrease insertion force need during the mating of the first and second connector 100, 300.

Each of the second insulators has a plurality of first portion 44 and a board like second portion 41. The first portions 44 and the second portion 41 of the second insulator are separately molded and assembled together. Each first portion 44 is disposed between the contacting portion 433 of the second shield 43 and the contacting portions 422 of corresponding second contacts pair 42. The first portion 44 of the second insulator has similar structure as the first portion 24 of the first insulator and so there is no burden needed to deliberate again.

The contacting portion 433 of the second shield 43 has a U-shaped inner face. The first portion 44 of the second insulator is secured in the U-shaped inner face. Each of the second shields 43 has a U-shaped fastening portion 432 extending along center portions of corresponding second contact pair. The fastening portion 432 defines a plurality of slots 4321 for making interference fit with the second portion 41 of the second insulator.

The second connector 300 further comprises a third shield 45 and a front housing 3. The third shield 45 has a board portion sealing the opens of the U-shaped fastening portions 432. The front housing 3 receives the contacting portion 422, 433 of the second contact 42 and the second shield 43.

The disclosure is illustrative only, changes may be made in detail, especially in matter of shape, size, and arrangement of parts within the principles of the invention.

What is claimed is:

1. A high speed connector assembly comprising:

a first connector comprising:

an array of first contacts arranged in lines, each line of first contacts being grouped in pairs adapted for transferring signal differential pairs, each of the first contacts having a contacting portion;

a plurality of first insulators each fastening at least one pair of first contacts; and a plurality of first shields arranged in lines which alternate with the lines of the first contacts in a repeated pattern of one line of the first contacts being arranged behind one line of the first shields, each of the first shields having a contacting portion corresponding to one differential pair of first contacts; and a second connector to mate with the first connector, the second connector having a main body, the main body defining a front face and a plurality of receiving holes in the front face, the second connector comprising:

an array of second contacts arranged in lines, each line of second contacts being grouped in pairs adapted for transferring signal differential pairs, each of the second contacts having a contacting portion to mate with the contacting portion of a corresponding first contact;

a plurality of second insulators each fastening at least one pair of second contacts; and a plurality of second shields arranged in lines which alternate with the lines of the first contacts in a repeated pattern of one line of the second contacts being arranged behind one line of the second shields, each of the second shields having a contacting portion to mate with the contacting portion of a corresponding first shield;

wherein the contact portions of each differential pair of first contacts and the contacting portion of corresponding first shield are received in same one of the receiving holes when the first connector and the second connector are mated.

2. A high speed connector assembly as claimed in claim 1, wherein each of the second insulator having a first portion disposed between the contacting portion of the second shield and the contacting portions of corresponding second pair of contacts, the first portion sheltering front ends of the second pair of contacts.

3. A high speed connector assembly as claimed in claim 2, wherein the first portion defines a cavity receiving a main portion of the contacting portion of the second contact.

4. A high speed connector assembly as claimed in claim 3, wherein each second contact comprises a fastening portion held by a second portion of the second insulator, the contacting portion of the second contact comprising a first contacting portion forwardly extending from the fastening portion, and a second contacting portion continuously and forwardly extending from the first contacting portion with a transverse offset comparing the first contacting portion, the contacting portion of corresponding first contact having similar first contacting portion and second contacting portion, when the first and second connectors are mated together, the second contacting portion of the first contact not scratching the second contacting portion of the second contact.

5. A high speed connector assembly as claimed in claim 4, wherein each first portion of the second insulator forms a protrusion abutting a side of the contacting portion in the cavity.

6. A high speed connector assembly as claimed in claim 4, wherein the first contacting portion is shaped like a planar board and the second contacting portion is shaped like a tuning fork.

7. A high speed connector assembly as claimed in claim 3, wherein the first portion and the second portion of the second insulator are separately molded and assembled together.

8. A high speed connector assembly as claimed in claim 1, wherein the contacting portions of each pair of second contacts and a corresponding contacting portion of the second shield have mating faces facing away from each other.

9. A high speed connector assembly comprising:

a first connector, comprising:

a pair of first contacts for transferring a signal differential pair, each of the first contacts having a contacting portion;

a first insulator fastening the pair of first contacts; and a first shield having a contacting portion beside the contacting portions of the pair of first contacts; and a second connector to mate with the first connector, the second connector comprising:

a pair of second contacts for transferring a signal differential pair, each of the second contacts having a contacting portion to mate with the contacting portion of a corresponding first contact;

a second insulator fastening the pair of second contacts; and a second shield having a contacting portion surrounding only one side of the contacting portions of the second contacts to leave the other side open, the contacting portion of the first shield sealing the open side and forming a sealed perimeter around the contacting portions of the first contacts and the second contacts when the first and second connectors are mated; wherein the contacting portions of the second contacts are flexible to sway towards the contacting portion of the first shield when mated with the contacting portions of the first contacts, the second connector having a first portion isolating the contacting portions of the second contacts from the contacting portion of the second shield and sheltering front ends of the second contacts with only one side of the contacting portions of the second contacts left reachable for the first contact pair contacts.

10. A high speed connector assembly as claimed in claim 9, wherein the contacting portion of the second shield having a U-shaped inner face, the first portion of the second insulator being secured in the U-shaped inner face.

11. A high speed connector assembly as claimed in claim 10, wherein the first insulator has a first portion sandwiched between the contacting portions of the first contact pair and the first shield.

12. A high speed connector assembly as claimed in claim 11, wherein the contact portion of the first shield is shaped like a planar board.

13. A high speed connector assembly as claimed in claim 9, wherein the second connector comprises an array of the second contacts in lines and an array of the second shields in lines which alternate with the lines of the second contacts in a repeated pattern of one line of the second contacts being arranged behind one line of the second shields, the second contacts in each line being grouped in pairs for transferring signal differential pairs, the pairs of second contacts in each line being held by the second insulator and having center portions buried therein, each of the second shields extending along center portions of a corresponding pair of second contacts in U-shaped cross-section.

14. A high speed connector assembly as claimed in claim 13, wherein the second connector further comprises a third shield having a board portion sealing an open of the U-shaped cross-section.

15. A high speed connector assembly as claimed in claim 9, wherein the second insulator comprises a second portion, the first portion being separately molded and associated with the second portion to cooperate with the pair of first contacts.

16. A high speed connector assembly as claimed in claim 9, wherein the second connector comprises an array of the second contacts in lines and an array of the second shields in lines which alternate with the lines of the second contacts in a repeated pattern of one line of the second contacts being arranged behind one line of the second shields, the contacting portion of the first shield sealing the open side of the contacting portions of said second shield in one line and making contact with the contacting portion of said second shield in an adjacent line.

17. A high speed connector assembly comprising:

a first connector comprising:

an array of first contacts arranged in lines, each line of the first contacts being grouped in pairs adapted for transferring signal differential pairs, each of the first contacts having a contacting portion;

a plurality of first insulators each fastening the corresponding one pair of first contacts; and a plurality of metallic first shields arranged in lines alternating with the lines of the first contacts so as to result in each first insulator being sandwiched between the corresponding one pair of first contacts and the corresponding first shield, each of the first shields having a contacting portion; and a second connector to mate with the first connector, the second connector comprising:

an array of second contacts arranged in lines, each line of the second contacts being grouped in pairs adapted for transferring signal differential pairs, each of the second contacts having a contacting portion to mate with the contacting portion of corresponding first contact;

a plurality of second insulators fastening the corresponding one pair of second contacts; and a plurality of metallic second shields arranged in lines which alternate with the lines of the second contacts in a repeated pattern of one line of the second contacts being arranged behind one line of the second shields, so as to result in each second insulator being sandwiched between the corresponding pair of second contacts and the corresponding second shield, each of the second shields having a contacting portion;

wherein the contacting portion of the first contact shares a same configuration with the contacting portion of the second contact under condition that the contacting portion defines unitarily a front deflectable section and a rear non-deflectable section, and in each pair of mated first and second contacts, the front deflectable section of the contacting portion of the first contact abuts against the rear non-deflectable section of the contacting portion of the corresponding second contact, and the front resilient contacting section of the contacting portion of the second contact abuts against the rear non-deflectable section of the contact portion of the first contact.

18. The high speed connector assembly as claimed in claim 17, wherein the rear non-deflectable section of the contacting portion of the first contact extends parallel to the first insulator, and the rear non-deflectable section of the contacting section of the second contact extends parallel to the second insulator.

19. The high speed connector assembly as claimed in claim 18, wherein the first insulator includes a protrusion to support the rear non-deflectable section of the contacting portion of the corresponding first contact, and the second insulator includes a protrusion to support the rear non-deflectable section of the contacting portion of the corresponding second contact.

20. The high speed connector assembly as claimed in 17, wherein only the first shield is equipped with a resilient section while the second shield is not, so as to allow the first shield to contact the neighboring second shield.

* * * * *